US009562342B2

(12) United States Patent
Winter et al.

(10) Patent No.: US 9,562,342 B2
(45) Date of Patent: Feb. 7, 2017

(54) SERRATED PLOW BLADE

(71) Applicants: Kent Winter, Willoughby, OH (US); William A. Sulesky, Medina, OH (US)

(72) Inventors: Kent Winter, Willoughby, OH (US); William A. Sulesky, Medina, OH (US)

(73) Assignee: Winter Equipment Company, Willoughby, OH (US)

( * ) Notice: Subject to any disclaimer, the term of this patent is extended or adjusted under 35 U.S.C. 154(b) by 0 days.

(21) Appl. No.: 14/847,943

(22) Filed: Sep. 8, 2015

(65) Prior Publication Data

US 2016/0069041 A1 Mar. 10, 2016

Related U.S. Application Data

(60) Provisional application No. 62/046,366, filed on Sep. 5, 2014.

(51) Int. Cl.

| | |
|---|---|
| ***E02F 3/815*** | (2006.01) |
| ***E02F 9/26*** | (2006.01) |
| ***E01H 5/06*** | (2006.01) |

(52) U.S. Cl.

CPC ..... *E02F 3/8157* (2013.01); *E01H 5/061* (2013.01); *E02F 3/8152* (2013.01); *E02F 9/26* (2013.01)

(58) Field of Classification Search

CPC ..... E02F 3/8152; E02F 3/8157; E02F 9/2883; E01H 5/061

USPC ..... 37/270

See application file for complete search history.

(56) References Cited

U.S. PATENT DOCUMENTS

| | | | | |
|---|---|---|---|---|
| 3,152,411 | A * | 10/1964 | Wood | E02F 3/8152 172/701.3 |
| 3,685,177 | A | 8/1972 | Hahn et al. | |
| 3,888,027 | A * | 6/1975 | Toews | E02F 9/285 172/701.3 |
| 3,934,654 | A * | 1/1976 | Stephenson | E01H 5/061 172/701.3 |
| 4,715,450 | A * | 12/1987 | Hallissy | E02F 3/8152 172/701.3 |
| 4,770,253 | A * | 9/1988 | Hallissy | E01H 5/061 172/701.3 |
| 5,148,616 | A | 9/1992 | Maguina-Larco | |
| 5,553,409 | A | 9/1996 | Irving | |
| 5,724,755 | A | 3/1998 | Weagley | |
| 6,041,529 | A | 3/2000 | Ruvang | |
| 6,854,527 | B2 * | 2/2005 | Manway | E02F 3/8152 172/701.1 |
| 7,266,914 | B2 | 9/2007 | Grant | |
| 7,596,895 | B2 | 10/2009 | Jones | |
| 7,631,441 | B2 * | 12/2009 | Hunt | E01H 5/061 37/232 |
| 7,765,726 | B2 * | 8/2010 | Kuper | E01H 5/061 172/701.3 |
| 7,836,615 | B2 | 11/2010 | Winter | |
| 7,874,085 | B1 | 1/2011 | Winter et al. | |

(Continued)

*Primary Examiner* — Gary Hartmann

(74) *Attorney, Agent, or Firm* — Fay Sharpe LLP

(57) ABSTRACT

A plow blade comprising a plurality of serrated blade sections. The plurality of serrated blade sections include a serrated bottom edge. Each of the plurality of serrated blade sections comprise a plurality of serrations. At least one of the plurality of serrations includes a blade wear indicator. A plurality of wear bars can be mounted to a rear side of the serrated blade sections. Each of the plurality of wear bars include a weldment of carbide matrix along a bottom edge.

14 Claims, 3 Drawing Sheets

(56) References Cited

U.S. PATENT DOCUMENTS

| | | | | |
|---|---|---|---|---|
| 8,024,874 | B2 | 9/2011 | McClanahan et al. | |
| 8,191,287 | B2 | 6/2012 | Winter et al. | |
| 8,844,173 | B2 | 9/2014 | Winter et al. | |
| 9,163,379 | B2 * | 10/2015 | Winter | E01H 5/061 |
| 9,428,874 | B2 * | 8/2016 | Winter | E01H 5/061 |
| 2011/0162241 | A1 * | 7/2011 | Wangsness | E01H 5/066 37/266 |
| 2012/0260537 | A1 | 10/2012 | Winter et al. | |
| 2015/0047234 | A1 | 2/2015 | Winter | |
| 2016/0039030 | A1 * | 2/2016 | Winter | E01H 5/061 219/615 |

* cited by examiner

SERRATED PLOW BLADE

This application claims priority to U.S. Provisional Patent Application No. 62/046,366, filed Sep. 5, 2014, by Kent Winter and entitled "SERRATED PLOW BLADE" and is incorporated herein by reference in its entirety.

BACKGROUND

The present disclosure generally relates to devices for improving the durability, performance and operation of plow blades. Specifically, the present disclosure provides for an improved plow blade edge, for example, snow plow blade edge.

Rough terrain and cold weather conditions have caused problems for snow plow blades for as long as there have been snow plows. Although many modifications and alternative designs have been made to snow plow blades in attempts to improve the life, durability, and performance of snow plow blades, in particular, the life, durability, and performance of snow plow blade edges, most of these modifications and alterations did not provide sufficient durability and performance improvement to deal with, among other things, the rough terrain and cold weather that snow plow blades are typically exposed to. Typically, prior art snow plow edges include a continuous edge that is in contact with the road surface therebelow. The typical snow plow edges are subjected to extreme impact and wear and can be destroyed due to the wear from the contact between the plow edge and the terrain below.

In addition, rigid prior art snow plow blade edges, including a continuous bottom edge, can damage the surface over which they are moved. Due to their rigidity and continuous snow plow blade edge, prior art plow blades transmit loads to the surface below. The present disclosure describes a device with resilient construction material and method of mounting which can be used to provide new plow blade edges or replace worn plow blade edges, in particular, snow plow blade edges or other surface plows, that overcome many of the limitations of the prior art.

BRIEF DESCRIPTION

One aspect of the present disclosure provides for a plow blade edge system which can be mounted to a mold board of a plow. One arrangement of the plow blade system can comprise a wear bar, a serrated blade, and plow guards. The wear bar can comprise a weldment of carbide matrix along a bottom edge for wear resistance. The wear bar can be welded to the serrated blade. The wear bar can be positioned behind the serrated blade. The wear bar can be comprised of a plurality of wear bar sections independently welded to the back of respective serrated blades, thereby forming plow guard protection over the entire length of the serrated blade. The wear bars can also include steel retainer plates for protection of the carbide matrix. The plow edge kit further comprises a plurality of fasteners that can pass through the holes of the plow guard, serrated blade, and corresponding holes of the mold board for securing the plow blade edge system to the mold board.

Another aspect of the present disclosure provides for a plow blade edge system comprising a serrated blade having a plurality of cut-outs (i.e. keyhole cut-outs) thereby forming a plurality of openings or channels along the bottom edge of the serrated blade. The serrated edge can comprise self-sharpening high strength steel. The serrated blade edge can cut through hard packed snow and ice easier than a continuous blade edge. The serrated blade can be comprised of a plurality of blade sections (i.e. 3 foot and/or 4 foot sections) including inter-locking terminal tabs for easy installation and positioning of adjacent sections. The cut-outs can also include a wear indicator (i.e. wear indicator line) that provides notice to the user that once the serrated blade edge retreats and/or is consumed, to the wear indicator line, then the serrated blade should be replaced.

Another aspect of the present disclosure provides for a plow blade edge kit for mounting to a mold board of a plow. The edge kit comprises a plurality of serrated blades including mounting holes for mounting to a mold board. The kit further includes mounting bushings. The serrated blades also include wear bar sections welded thereto.

DETAILED DESCRIPTION

Figure 1:
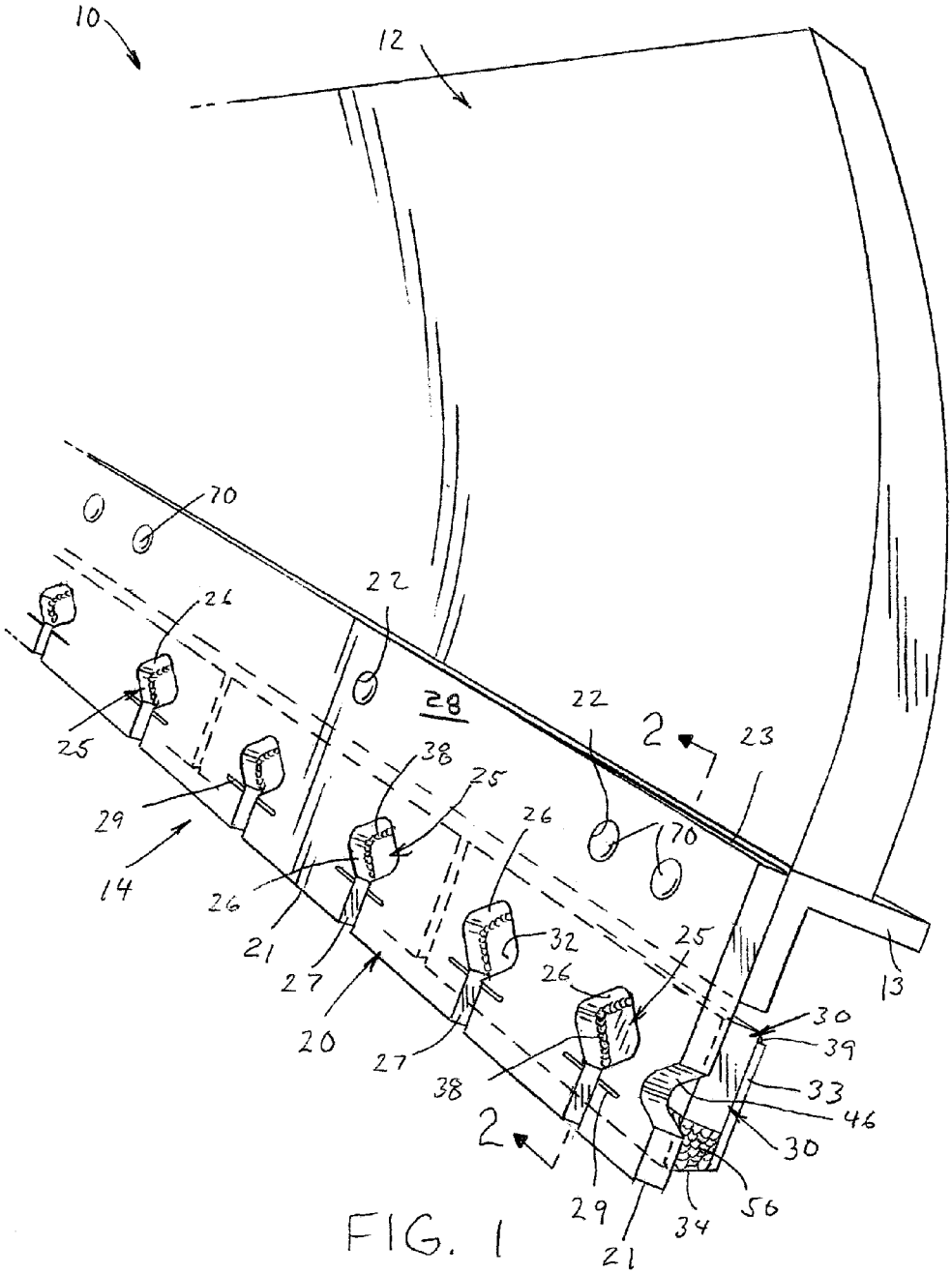
FIG. 1 is a front perspective view of a serrated blade section and plow blade edge system according to one aspect of the present disclosure.

FIG. 1 is a perspective view of a plow assembly 10 including a plow body 12 which can be hemispherical and funnel shaped steel construction, or other materials, for deflecting snow or other media. Plow assembly 10 is typically attached to a vehicle (not shown) by means of an appropriate frame or housing (also not shown). The vehicle may be any vehicle ranging from a standard car or pickup truck to a sand and salt carrying dump truck to a road grader having a belly mounted blade to huge earth moving or snow moving plows. The means of attaching plow body 12 to a vehicle may also typically include some form of hydraulic mechanism for positioning plow assembly 10 as desired, as is typical in the art. The plow assembly 10 may also include one or more reinforcing members (not shown) to provide strength and rigidity to plow body 12. Reinforcing members are typically standard structural angles which are attached to the back of plow body 12, for example, by means of welding.

A plow blade edge system or kit 14 having wear resistant surfaces including serrated edge blades 20 and impact or wear bars 30, made in accordance with the teachings of the present disclosure, is illustrated in FIGS. 1-4. The wear bars 30, according to a first embodiment, include a mounting face 32 which can be secured to a backside 24 of the serrated blade 20. The wear bars 30 can be mounted close to a cutting edge 21 of the plow blade edge system 14. One of the advantages of the wear bars 30 is that they can be welded to the serrated blade 20 such that the serrated blade 20 and wear bars 30, can be combined all in a single plow blade edge system unit 14. It is to be appreciated that the present construction and assembly eliminates complicated and bulky supporting structures, additional mounting elements and thereby reduces the time and costs of fitting the plow blade edge system 14 onto the snow plow blade 12.

It is to be appreciated that the mounting openings 22 for the plow blade edge system 14 are located proximal to a top edge 23 of serrated blade 20 at a standard spacing of 8 inch or 12 inch centers. As shown, the serrated blade 20 can be mounted to a plow body base member or moldboard 13 at the bottom of snow plow blade 12 having 12 inch bolt hole centers or other spaced mounting arrangements.

In one arrangement (FIGS. 3 and 4), the wear bars 30 are pre-mounted to the serrated blade 20. Wear surfaces 34 of wear bars 30 reside close to, and in general alignment with, the blade cutting edge 21 and are thus a more integral part of the blade system 14 and therefore, capable of absorbing more of the undesirable abrasive wear and vibration (i.e. in use).

At least one channel 40 can be formed between the serrated blade 20 and the wear bars 30 at the time of assembly. A carbide matrix wear pad or weldments 50 can be welded into the channel 40 to provide improved impact performance, wear resistance, and longer life to the plow blade edge system 14.

Figure 2:
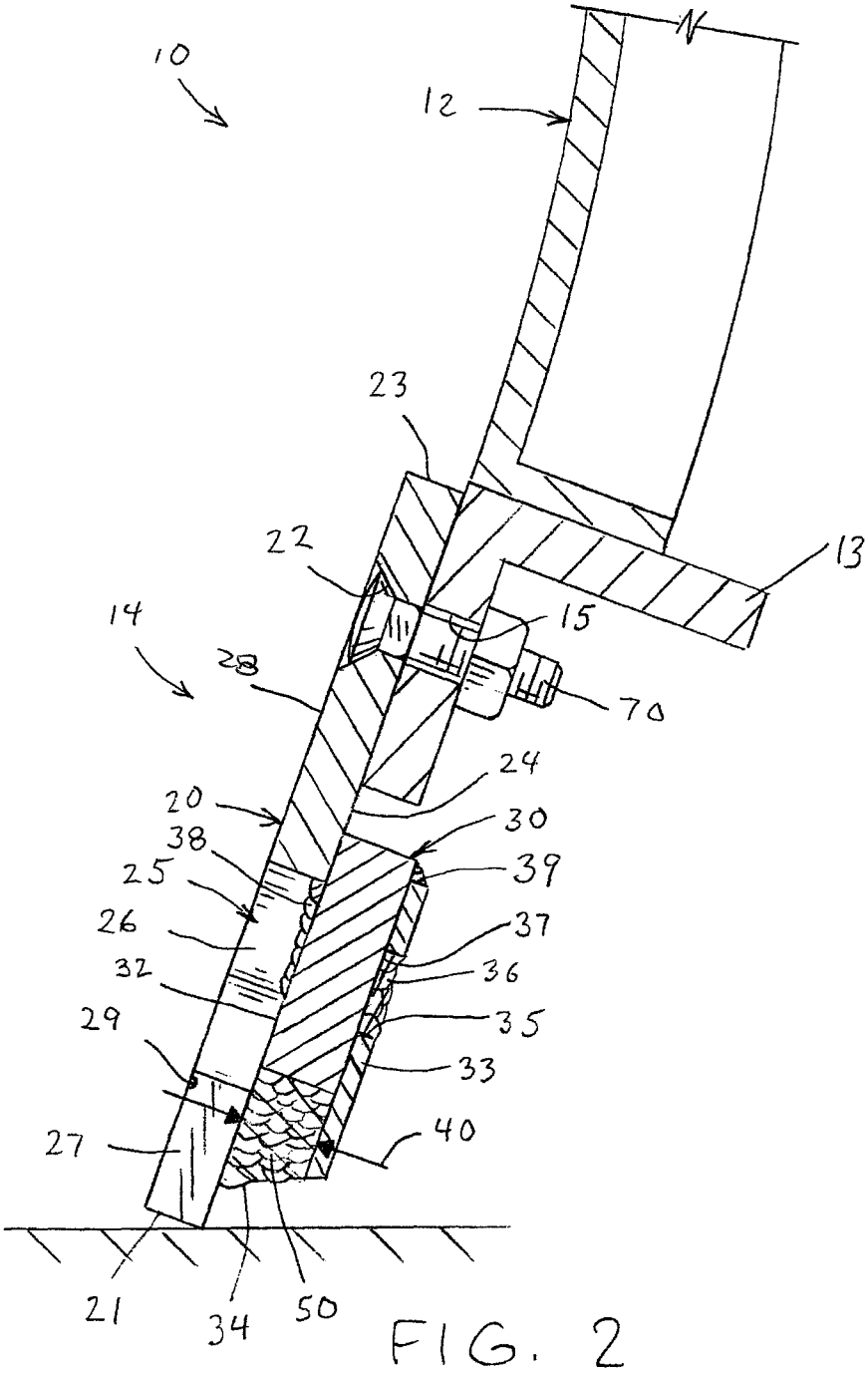
FIG. 2 is a cross sectional view taken along section lines 2-2 in FIG. 1 according to a first mounting arrangement of the plow blade system.

Subsequent to assembly, the channels 40 can be filled and/or overfilled by welding therein layered carbide matrix 50. The layered carbide matrix 50 can be composed of a series of layered deposits one on top of another until the channel 40 is filled or overfilled. Overfilling the channel 40 can result in a convex or bulbous layer of carbide matrix terminating beyond, i.e. extending below, the wear surface of the wear bar 30. The matrix 50 provides a reconstitutable embedded weldment or resistor for increased wear resistance of the wear surface. In one exemplary embodiment, one longitudinal channel 40 extends along substantially the length of the wear bar 30. As shown in FIG. 2, the welding deposit 50 (in an unworn state) in the channel 40 can overfill the channel forming substantially bulbous deposit extending outwardly from the wear or bottom surface of the wear bar 30.

The weldments 50 can be aligned with the wear surface such that when the plow assembly is in use and traveling along the road surface, the weldments 50 are transverse to the direction of travel. Alternatively, the weldments 50 can be aligned with or canted to, the direction of travel (not shown). The surface area of the weldments can comprise from about 35% to about 65% of the total surface area of the bottom wear surface comprising the serrated blade 20 and the wear bar 30.

The weld deposits 50 can have the following analysis (balance iron):

| C | Cr | Mo | Si | Mn | Hardness/Rc |
|---|---|---|---|---|---|
| X100<br>2.60 | X100<br>12.00 | X100<br>0.62 | X100<br>1.37 | X100<br>.77 | 55-60 |

Conventional hard-facing or wear-facing weldments can be used for the deposits 50. So-called chrome carbide steels are the most common, e.g., STOODY COMPANY NO. 121, although vanadium carbide (STOODY NO. 134) and tungsten carbide ones also can be used very effectively. It is to be appreciated that the weldment material 50 deposited in the channel 40 has a higher hardness than the surrounding materials. The weldment metal 50 must be abrasion-resistant. Generally, it is a high chrome ferrous metal weld. It is reconstitutable in the sense that it can be repaired or replaced by redeposition of carbide matrix by welding.

Weld deposit 50 in channel 40 can be transverse to the direction of travel. The wear surface and the embedded or integrated weldments 50 help to support the cutting edges of the serrated blade 20 and wear bars 30 such that the abrasive action and impact from the roadbed works on the weldments 50 and the serrated blade cutting edges 21, thereby substantially prolonging the life of the cutting edge 21 of serrated blade 20. The present edge system 14 of welded wear bars 30 and serrated blades 20 are intended to perform better than mechanically fastened solid carbide bars would under the extreme conditions of vibration, impact and thermal shock experienced by plow blades.

As described above, one aspect of the present disclosure provides for the plow blade edge system 14 to be easily mounted to a mold board 13 of a plow 12. The plow blade system 14 can comprise wear bars 30, serrated blades 20, and plow guards (not illustrated). The wear bar 30 can comprise a weldment of carbide matrix 50 built up along a bottom edge (i.e. deposited in a channel 40) for wear resistance. The carbide matrix 50 can comprise chrome carbide, tungsten carbide, or similar. The wear bar(s) 30 can be welded to respective serrated blades 20. The wear bars 30 can be positioned behind the serrated blades 20. The wear bar 30 can be comprised of a plurality of wear bar sections independently welded to the back of respective serrated blade sections 20, thereby forming plow guard like protection over nearly the entire length of the serrated blade 20. The wear bars 30 can also include steel retainer plates 33 for forming channels 40 between plates 33 and serrated blade 20, and for protection of the carbide matrix 50. The plow edge kit 14 further comprises a plurality of fasteners 70 that can pass through the holes 22 of the serrated blade 20, and corresponding holes 15 of the mold board 13 for securing the blade system 14 to the mold board 13.

Another aspect of the present disclosure provides for a plow blade edge kit 14 for mounting to the mold board 13 of a plow 12. The edge kit 14 comprises a plurality of serrated blade sections 20 including mounting holes 22 for mounting to a mold board 13. The kit 14 can further include mounting bushings. The serrated blades 20 also include wear bar sections 30 welded thereto.

Another aspect of the present disclosure provides for a serrated blade 20 having a plurality of cut-outs 25 (i.e. keyhole cut-outs) thereby forming a plurality of openings or channels 27 along the bottom edge 21 of the serrated blade 20. The serrated edge 21 can comprise self-sharpening high strength steel. The serrated blade edge 21 can cut through hard packed snow and ice easier than a continuous blade edge. The serrated blade 20 can be comprised of a plurality of blade sections (i.e. 2, 3 and/or 4 foot sections) including inter-locking terminal tabs for easy installation and positioning of adjacent sections. The cut-outs 25 can also include a wear indicator 29 (i.e. wear indicator line) that provides notice to the user that once the serrated blade edge 21 retreats and/or is consumed, to the wear indicator line 29, then the serrated blade 20 or blade section should be replaced.

The serrated blade 20 can be comprised of high strength steel. The blade 20 can be from about 4 in. to about 12 in. in height and from about 0.25 in. to about 1 in. in thickness. The serrated blades 20 can be made in predetermined lengths, i.e. 1 ft., 2 ft., 3 ft., and 4 ft. Plow guards optionally mounted to the front side of the serrated blade (not illustrated) can comprise carbide matrix along a lower edge welded into a channel. The plow guards can be installed where extra blade protection is needed. For curb protection, the plow guards can also comprise a curved section along an outer edge for protection of the blade edge from wear against a curb.

The keyhole cut-outs 25 of the serrated blade 20 can comprise a narrow channel 27 opened at a bottom edge 21 extending upward for a distance and then expanding into a relatively larger opening 26 at the top or terminal end of the keyhole opening 25. The open channel, i.e. plurality of open channels 27, along the serrated blade edge 21 and adjacent to the road surface provides for a more effective cutting plow edge that can cut effectively through hard packed snow and ice. The channel openings 27 along with the intermittent blade edge 21 therebetween provides for a more effective "slicing" ability such that the serrated blade edge 21 can tear and cut through the snow and ice as the plow assembly 10 is pushed along a road surface. The serrated edge 21 provides for increased "grab" of the material in front of the plow blade 12. The high points, i.e. the edge sections 21 in contact with the road surface will meet the snow and ice first, thereby putting more pressure per area available at these points. This allows the serration channels 27 to puncture and tear through the ice and snow faster. The serrated edge 21 can be a self-sharpening high strength steel blade edge. It is to be appreciated that in typical plowing operations, the plow blade 12 is angled relative to the direction of travel. Thus, the plow blade 12 is presented at an angle to the snow and ice as the plow blade 12 is pushed along. The typical angle of address enables the snow and ice to be dislodged from the road surface and then travel in a downstream manner to the right of the plow blade 12, thereby pushing the snow and ice to the right side of a road surface.

The wear bar sections 30 can each include a plurality of apertures 35 therethrough, for mounting of the retainer plate 33 to the wear bar 30. One arrangement can comprise plug welds 36 through the apertures 35, thereby making contact with a rear side 37 of the wear bar 30. In addition, fillet welds 39 can be provided for securing the retainer plate 33 to the wear bar 30. The enlarged head 26 of the keyhole cut-outs 25 can also include slot or fillet welds 38 along at least a portion thereof, thereby securing the serrated blade 20 to a front side 32 of the wear bar sections 30. It is to be appreciated that the fillet welds 38 are recessed from a front face 28 of serrated blade 20 and are shielded from abrasive action. The combination of the serrated blade 20 and the wear bar sections 30 can subsequently be mounted to the mold board 13.

It is to be appreciated that the serrated edge 21 results in a teeth like design along the lower edge that can easily penetrate the ice and packed snow as the plow blade 12, at a typical attack angle, is pushed along the roadway. The resultant action is a slicing cut as the plow blade 12 is presented at an angle to the substrate in front of the plow.

Each of the serrated blade sections 20 can include a male tab 44 and a female notch 46 at opposing ends for interlocking of adjacent serrated blade sections 20.

The number of serrated blade segments 20 mounted to a plow body will vary depending upon the size of plow body 12 used. For example, the length of the serrated blade 20 is limitless, but serrated blades 20 typically will have sections of 3 or 4 foot lengths. In this manner, any combination of two, or three, blade segments 20 can be combined to extend across a plow blade having a length of 6, 7, 8, 9, 10, 11, or 12 feet.

Figure 3:
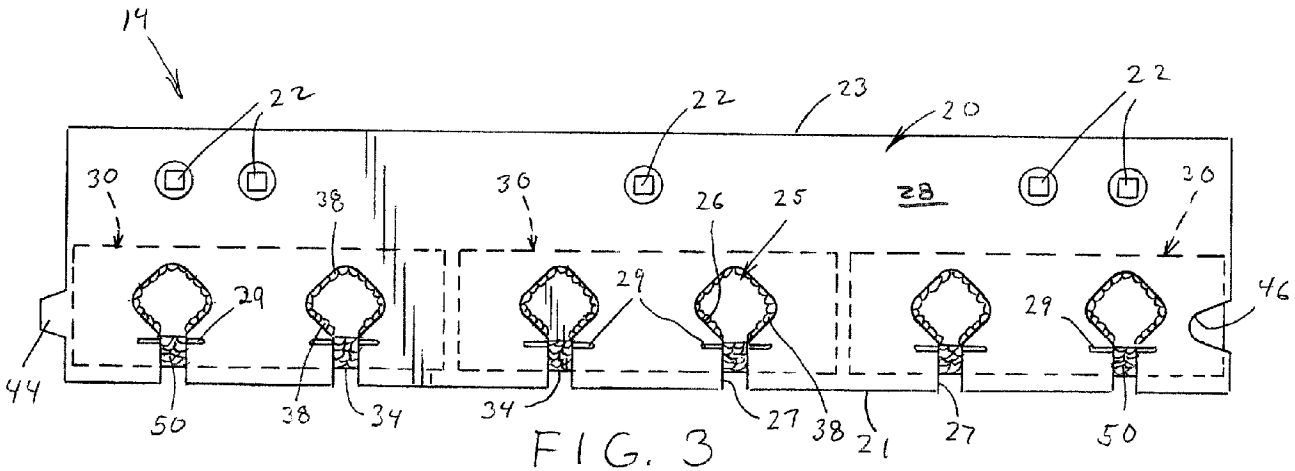
FIG. 3 displays a front view of the combination of plow guard serrated blade section and wear bar sections; and, FIG. 4 displays a rear view of the combination of plow guard serrated blade section and wear bar sections.
Figure 4:
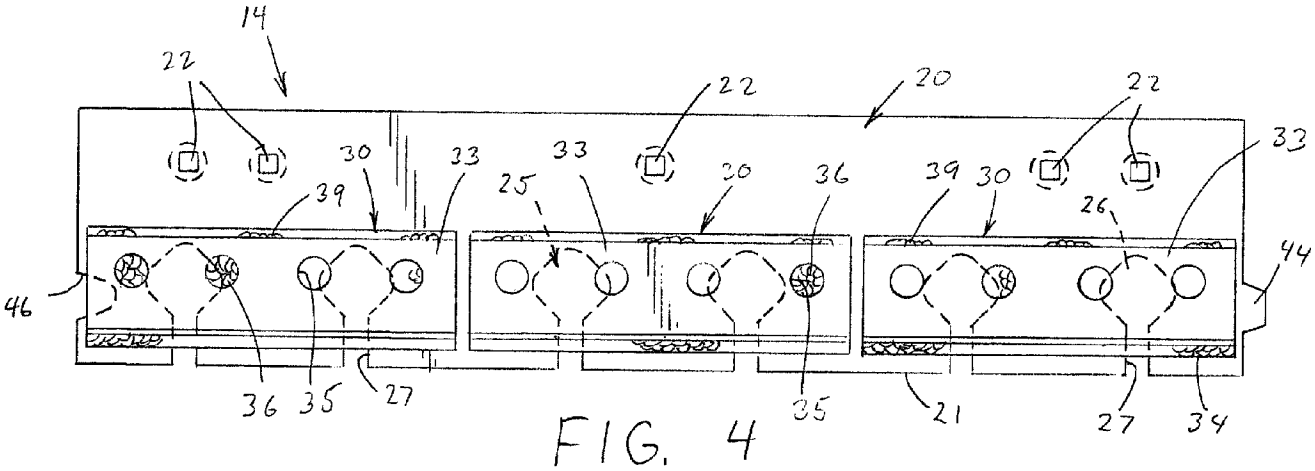

Referring now to FIG. 3, there is shown a wear termination or replacement line 29 on blade 20. The wear replacement line 29 indicates when the plow blade edge system 14 should be replaced. The wear line 29 can be reached, for example, when all, or substantially all, of the carbide matrices 50 have worn off, or abraded away. As described above, any number of combinations of serrated blade 20 exemplary lengths can be used to accommodate varying size of the plow blade body from 6 feet to 12 feet, et al. The end 44 of one blade 20 is designed to interlock an adjacent end 46 of another blade 20 thereby stabling the plow blade edge system 14. Thus, the male interlock section 44 of one blade 20 can be interlocked with the female section 46 of another adjacent interlock blade 20. The male 44 and female 46 interlock sections overlap a joint of adjacent blades thereby stabilizing the serrated blade 20 sections. In conjunction therewith, one or more integral plow blade edge sections 14 can be independently mounted or replaced. In this manner, one person can single-handedly replace one (or more) integral plow blade edge sections 14 as needed in one simple section swap.

In another embodiment, the plow blade edge device 14 can further include a plow guard or curb guard (not illustrated) attached to serrated blade 20 and positioned along a front side. The guards can provide even further protection and wear resistance to moldboard 13 and plow body 12. The guards can also include a carbide matrix along a bottom edge for increased blade end protection.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A plow blade, comprising:

a plurality of serrated blade sections;

said plurality of serrated blade sections including a serrated bottom edge;

each of said plurality of serrated blade sections comprise a plurality of serrations;

at least one of said plurality of serrations includes a blade wear indicator;

a plurality of wear bars mounted to a rear side of the plurality of serrated blade sections; and, each of the plurality of wear bars include a weldment of carbide matrix along a bottom edge.

2. The plow blade as recited in claim 1, wherein said wear bars are welded to a backside of said plurality of serrated blade sections.

3. The plow blade as recited in claim 2, further including at least two wear bars welded to the backside of each said serrated blade section.

4. The plow blade as recited in claim 1, wherein said serrated blade sections include an interlocking joint spanning across a merged line between a first serrated blade section and a second serrated blade section.

5. The plow blade as recited in claim 1, wherein said serrated bottom edge comprises a plurality of cutouts forming a plurality of channels along said serrated bottom edge.

6. A plow blade edge system, comprising:

a serrated blade section including a plurality of cutouts;

said plurality of cutouts forming a plurality of channels along a bottom edge of said serrated blade; and, a plurality of wear bars mounted to a rear side of said serrated blade section.

7. The plow blade edge system as recited in claim 6, wherein each of the plurality of wear bars include a weldment of carbide matrix along a bottom edge.

8. The plow blade edge system as recited in claim 7, wherein said wear bars include a retainer plate welded to a back side of said wear bar for forming a channel for the depositing of said weldment of carbide matrix.

9. The plow blade as recited in claim 6, wherein said wear bars are welded to a backside of said plurality of serrated blade sections.

10. The plow blade as recited in claim 9, further including at least two wear bars welded to the backside of each said serrated blade section.

11. The plow blade as recited in claim 6, wherein said serrated blade sections include an interlocking joint spanning across a merged line between a first serrated blade section and a second serrated blade section.

12. The plow blade as recited in claim 6, wherein said serrated bottom edge comprises a plurality of cutouts forming a plurality of channels along said serrated bottom edge.

13. The plow blade edge system as recited in claim 6, wherein said cutouts form a mating surface between said serrated blade and said wear bar; and, said mating surface includes a series of slot welds for securing said wear bars to said serrated blade.

14. The plow blade edge system as recited in claim 13, wherein said slot welds are recessed from a front surface of said serrated blade.

* * * * *